US005112342A

United States Patent [19]

Foerster et al.

[11] Patent Number: 5,112,342

[45] Date of Patent: May 12, 1992

[54] DEPILATOR

[75] Inventors: Gerhard R. H. Foerster, Vienna, Austria; Foppe Kramer, Drachten; Robert H. Munnig Schmidt, Groningen, both of Netherlands; Franciscus M. J. Van Roemburg, Klagenfurt, Austria

[73] Assignee: U.S. Philips Corp., New York, N.Y.

[21] Appl. No.: 483,194

[22] Filed: Feb. 20, 1990

[30] Foreign Application Priority Data

Mar. 9, 1989 [NL] Netherlands ..... 8900576

[51] Int. Cl.[5] ..... A61B 17/00

[52] U.S. Cl. ..... 606/133; 606/131; 30/34.2

[58] Field of Search ..... 17/11.1 R; 30/34.2, 30/43.4; 606/131-134

[56] References Cited

U.S. PATENT DOCUMENTS

| | | | |
|---|---|---|---|
| 2,714,788 | 8/1955 | Giovanna | 606/133 |
| 4,279,253 | 7/1981 | Haes et al. | 606/133 |
| 4,675,998 | 6/1987 | Thijjse | 30/34.2 |
| 4,950,274 | 8/1990 | Locke et al. | 606/133 |

FOREIGN PATENT DOCUMENTS

| | | | |
|---|---|---|---|
| 0147285 | 7/1985 | European Pat. Off. | 606/133 |
| 57-54725 | 11/1982 | Japan . | |

*Primary Examiner*—Stephen C. Pellegrino
*Assistant Examiner*—Michael Rafa
*Attorney, Agent, or Firm*—Ernestine C. Bartlett

[57] ABSTRACT

A depilator is provided comprising a housing which includes a skin-following surface for the skin to be depilated and at least one drivable hair pulling element rotatably mounted in the housing, the axis of the element being directed perpendicular to the skin-following surface. A first hair pulling element is arranged annularly while a second hair pulling element adjoins the inside wall of the first hair pulling element.

18 Claims, 3 Drawing Sheets

DEPILATOR

FIELD OF THE INVENTION

The invention relates to a depilator having a housing which includes a skin-following surface for the skin to be depilated and at least one drivable hair pulling element whose axis is directed perpendicular to the skin-following surface and is borne or mounted in the housing.

BACKGROUND OF THE INVENTION

Such a depilator is known, for example, from Japanese Patent Specification JP-UM 57-54725. The hair pulling elements in this device are formed by two rollers. A pulling force is exerted for only a brief moment on a hair clamped between the rollers with a relatively large opening between them, so that it becomes necessary to take specific measures to avoid having the skin end up between the rollers causing considerable pain to the user.

SUMMARY OF THE INVENTION

An object of the invention is to avoid these and other disadvantages and, therefore, it is characterized in that a first hair pulling element is arranged annularly and a second hair pulling element adjoins the inside wall of the first hair pulling element.

BRIEF DESCRIPTION OF THE DRAWINGS

In specific embodiments of the invention:

the second hair pulling element is drivably coupled in a rotatable fashion to an electromotor and the first hair pulling element can be driven by means of the second hair pulling element; and/or the second hair pulling element is rotatably borne or mounted on a frame which is rotatable around the axis of rotation of the first hair pulling element; and/or the direction of rotation of the frame corresponds with the direction of rotation of the first hair pulling element; and/or the direction of rotation of the frame is opposite to the direction of rotation of the first hair pulling element; and/or there is a support member inside the first annular hair pulling element and the second hair pulling element is located between the first annular hair pulling element and the support member; and/or the support member can be driven in a rotatable fashion; and/or the second hair pulling element is arranged as an annular deformable element compressed between the first annular hair pulling element and the support member; and/or at least one of the hair pulling elements has a cladding of a rubber-elastic material; and/or the hair pulling elements have corresponding teeth; and/or there is a plurality of second hair pulling elements inside the first hair pulling element.

Figure 1:
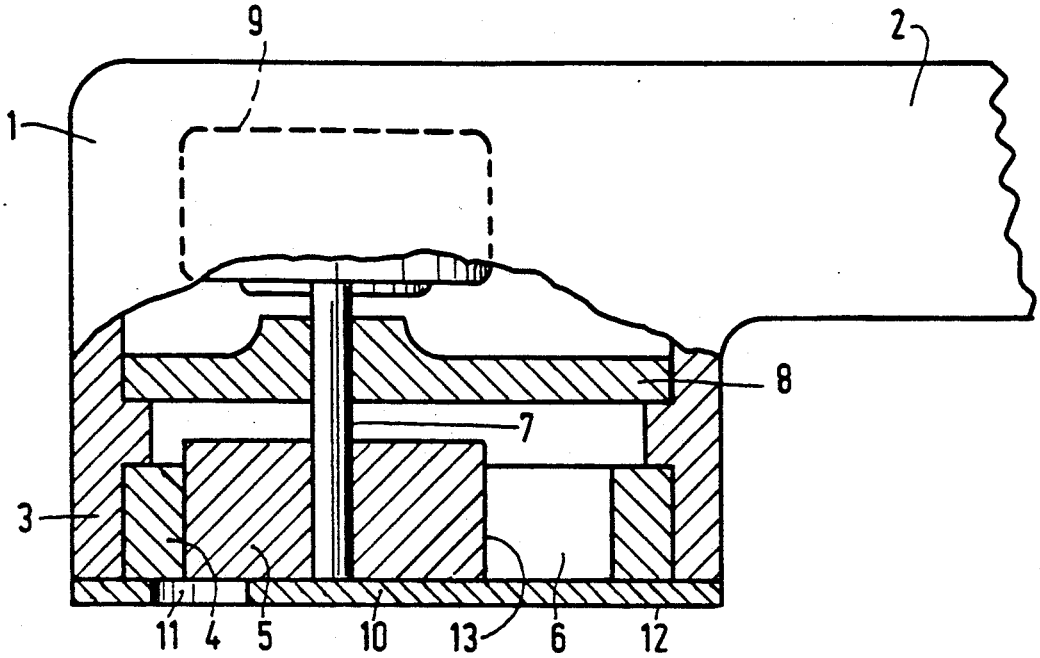
Figure 2:
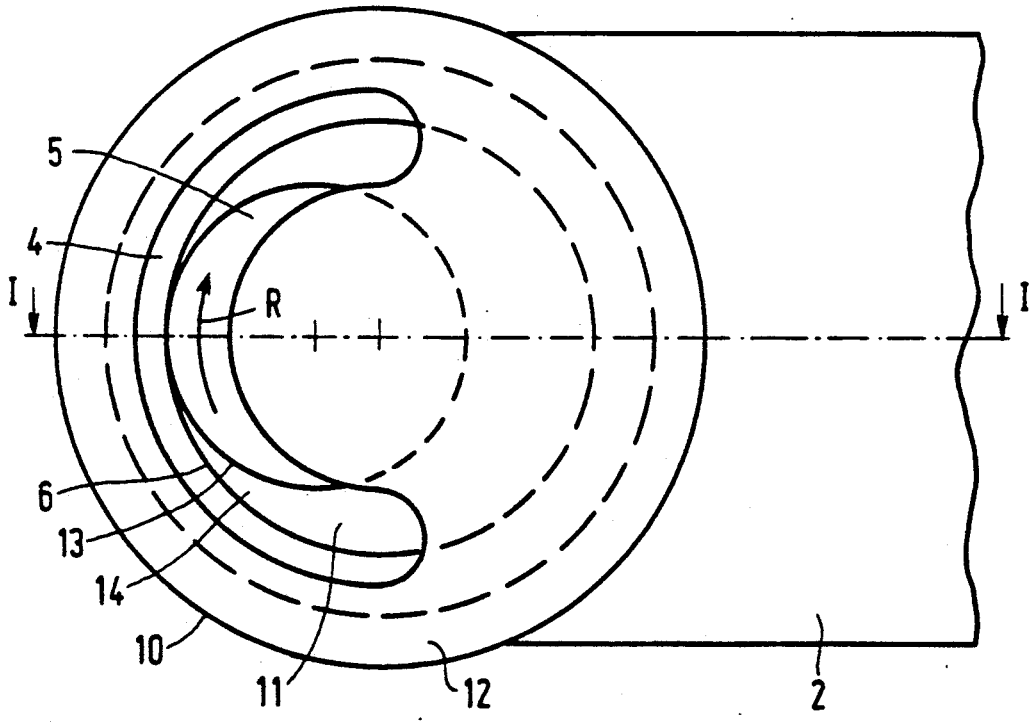
Figure 3:
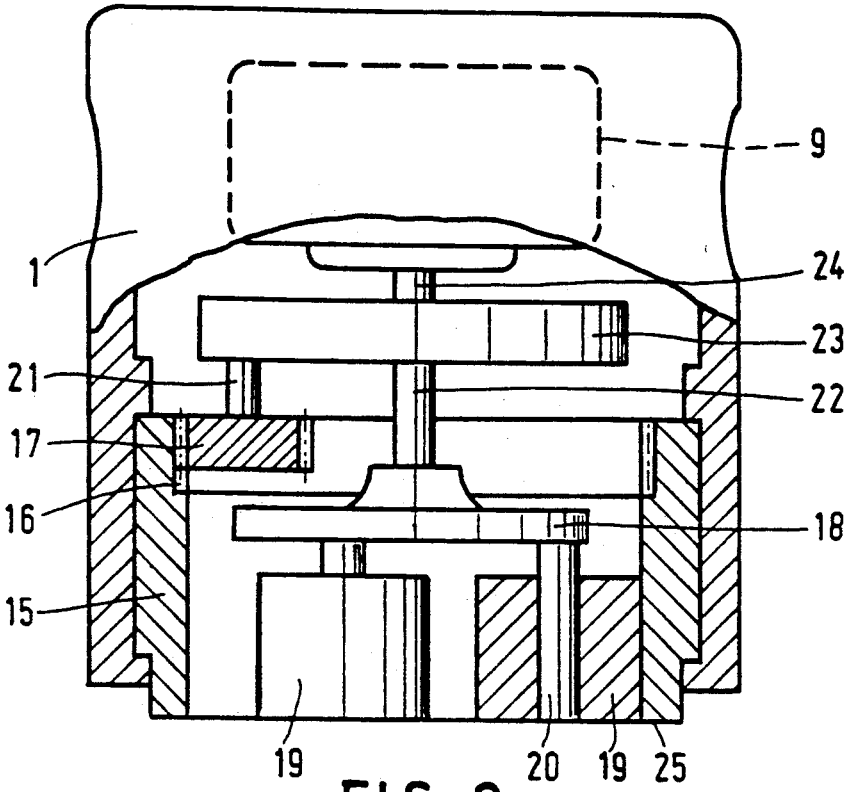
Figure 4:
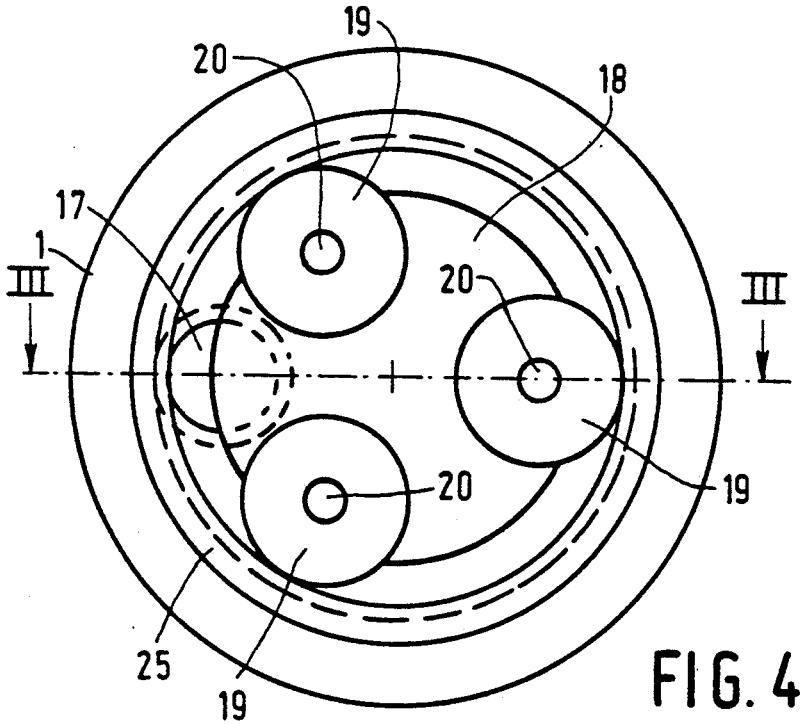
Figure 5:
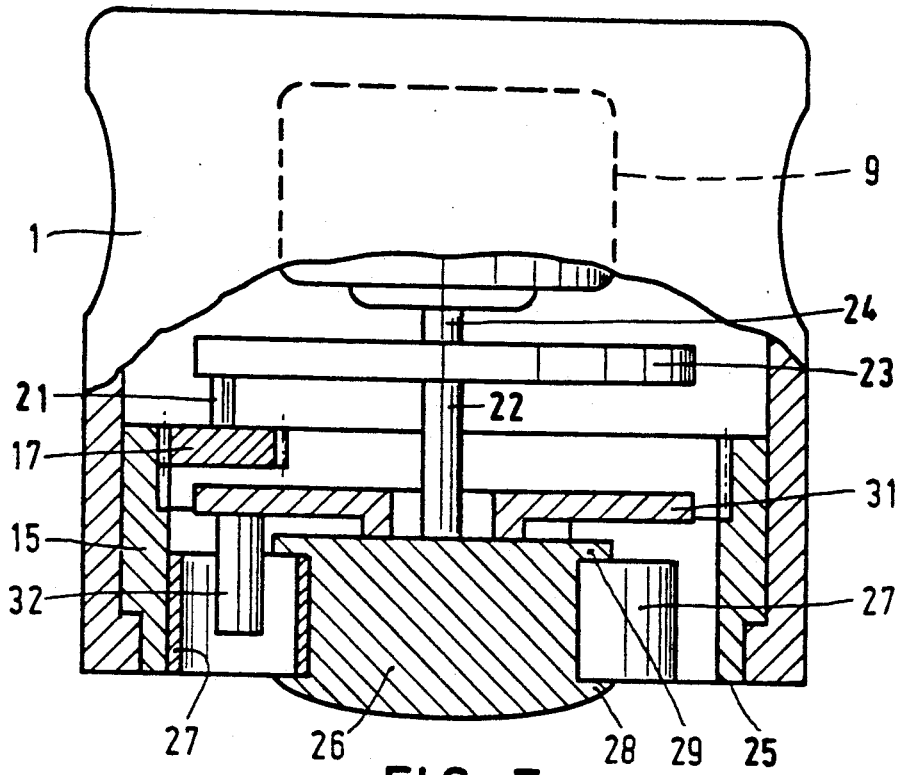
Figure 6:
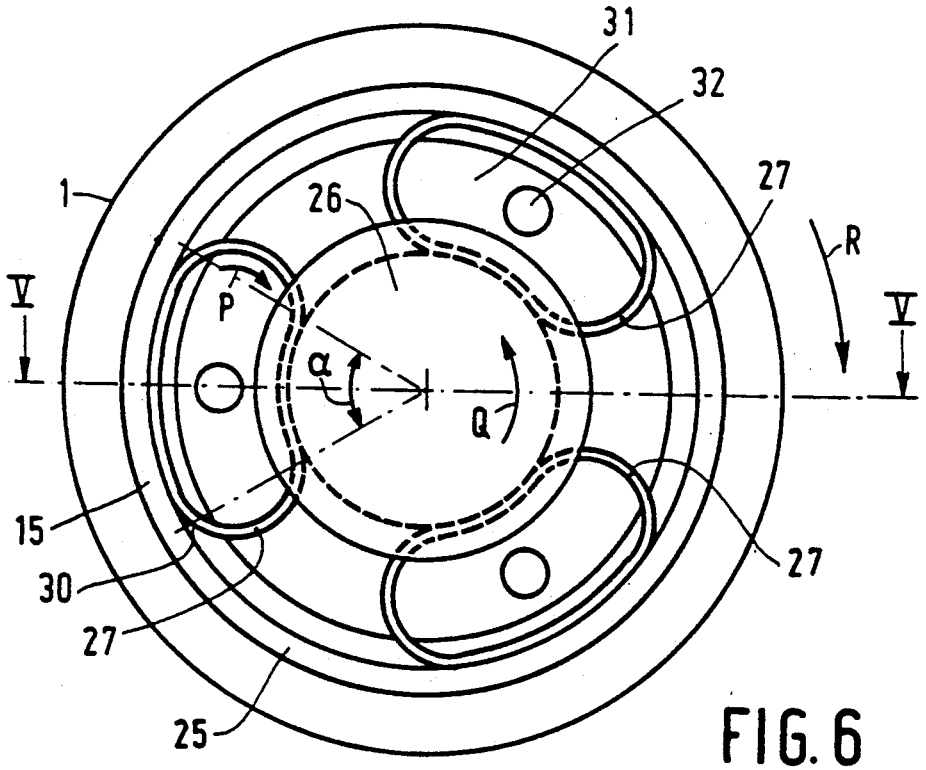

The invention will be explained hereinafter with reference to a description of the exemplary embodiments represented in the drawing Figures, in which:

FIG. 1 shows the depilator in a plan view and partly in a sectional view along the line I—I in FIG. 2, FIG. 2 is a bottom view of the device of FIG. 1, FIG. 3 shows a different embodiment of the invention, in plan view and partly in a sectional view taken along the line III—III in FIG. 4; FIG. 4 is a bottom view of the device of FIG. 3;

FIG. 5 shows yet another embodiment of the invention in a plan view and partly in a sectional view taken along the line V—V of FIG. 6; and FIG. 6 is a bottom view of the device of FIG. 5.

DETAILED DESCRIPTION OF PREFERRED EMBODIMENTS

The depilator as shown in FIGS. 1 and 2 comprises a housing 1, part 2 of which is used as a grip. In an annular wall portion 3 of the housing a first annular hair pulling element 4 is borne or mounted rotatably. A second cylinder-shaped hair pulling element 5 adjoins the inside wall 6 of the first hair pulling element 4 and has a shaft 7 which is rotatably borne or mounted in a bearing plate 8. The shaft 7 is coupled to an electromotor 9. The annular wall portion 3 is shut off by a plate 10 comprising a hair entry aperture 11.

When the device is used, the skin-following surface 12 of the plate 10 rests against the skin. The electromotor 9 rotatably drives the second hair pulling element 5, for example, in the direction R (FIG. 2). As a result of the friction between the outside wall 13 of second hair pulling element 5 and the inside wall 6 of first hair pulling element 4 the first hair pulling element is driven in this direction. A hair ending up in the wedge-shaped opening 14 between the hair pulling elements through the hair entry aperture 11 will be clamped between these hair pulling elements and, by their rotating movement, will be pulled out of the skin.

As a result of the combination of an annular hair pulling element and a cylinder-shaped hair pulling element, whose axis is directed perpendicular to the skin-following surface 12, the wedgeshaped opening 14 is much narrower than in the case of two cylinder-ahaped openings, thereby reducing the chance of part of the skin being squeezed between the two hair pulling elements. In addition, also the distance over which the hair is clamped by the two hair pulling elements is longer.

In the embodiment shown in the FIGS. 3 and 4 the first annular hair pulling element 15 comprises a gear ring 16 engaging a pinion 17. On a drivable frame 18 three cylinder-shaped second hair pulling elements 19 are rotatably mounted on the shafts 20. Both the pinion 17 and the frame 18 are driven by the electromotor 9 by means of the respective shafts 21 and 22, a prior-art gear transmission 23 and the shaft 24. The direction of rotation of the frame 18 may be the same as or the opposite of that of the annular hair pulling element 15, whereas, however, the number of revolutions per minute of the annular hair pulling element 15 will generally be chosen to be much higher than that of the frame 18. Because of the fact that three second hair pulling elements 19 are used and also because of the rotating movement of the frame 18 on which the hair pulling elements 19 are mounted, a considerably greater chance of seizing a hair will be realized than with the embodiment of the FIGS. 1 and 2.

In the second embodiment a cover plate is not used so that a skin-following surface is defined by the annular end surface 25 of the hair pulling element 15.

The operation of the embodiment as shown in FIGS. 3 and 4 is, for that matter, fully identical with that of the embodiment shown in the FIGS. 1 and 2.

In the embodiment shown in FIGS. 5 and 6 also a first annular hair pulling element is used which comprises a gear ring 16 and which may be driven, for example, in the direction of rotation R by the motor 9 by means of a pinion 17, a shaft 21, a gear transmission 23 and a shaft 24. Inside the first annular hair pulling element 15 an essentially cylindrical support member 26 is coupled to the electromotor 9 by means of the central shaft 22 and the gear transmission 23 also in a rotatably drivable fashion. Between the annular hair pulling element 15 and the support member 26 three annular deformable second hair pulling elements 27 are compressed. These second hair pulling elements 27 are arranged as metal band rings and locked between the flares 28 and 29 of the support member 26.

In this embodiment also the skin-following surface is defined by the annular end surface 25 of the hair pulling element 15.

The support member 26 is driven, for example, in the direction of rotation Q. As a result of the friction between the walls of the hair pulling elements 15, 27 and the support member 26, the second hair pulling elements 27 are likewise driven, see arrow P. The number of revolutions per minute of the first annular hair pulling element 15 and the support member 26 may be selected such that, for example, the second hair pulling elements 27 retain their places relative to the housing 1.

A hair ending up in the wedge-shaped opening 30 is clamped between the first and second hair pulling elements and taken along by the movement of these elements and removed. The angle $\alpha$ (FIG. 6) through which the first annular hair pulling element 15 is turned during the clamping of the hair is larger when using the annular deformable second hair pulling elements 27 than when using, for example, the cylindrical hair pulling elements 19 of the embodiment shown in FIGS. 3 and 4 under constant conditions, so that the chance of pulling out the hair is also increased.

It is possible to manufacture the second hair pulling elements of a different material, for example, of a synthetic tape and they may also be manufactured from a material having rubber-elastic properties.

Owing to a different relation between the numbers of revolutions per minute of the first annular pulling element 15 and the support member 26 the situation may occur in which, for example, the hair pulling elements 27 relative to the housing move also in the direction of rotation R but more slowly than the first annular hair pulling element 15. This will still enlarge the angle $\alpha$ described hereinbefore. The numbers of revolutions per minute may also be chosen so that the second hair pulling elements move in a direction opposite to R relative to the housing. Alternatively, it is possible not to couple the support member 26 to the electromotor but to arrange the support member rigidly or freely rotatably.

In order to guarantee that the mutual position of the second hair pulling element 27 is maintained, a freely rotatable disc 31 is present over the support member 26 which disc has locating pins 32 engaging the annular second hair pulling elements 27.

We claim:

1. A depilator having a housing which includes in a wall thereof a skin-following surface for the skin to be depilated; at least one drivable first hair pulling element having an inside wall and rotatably mounted in the housing, the axis of the first element being directed perpendicular to the skin-following surface, and a cylindrical second hair pulling element adjoining the inside wall of the first hair pulling element, the first hair pulling element being arranged annularly relative to at least the cylindrical second hair pulling element.

2. A depilator as claimed in claim 1, wherein the second hair pulling element is drivably coupled in a rotatable fashion to an electromotor and the first hair pulling element being driven by means of the second hair pulling element.

3. A depilator as claimed in claim 1 wherein the second hair pulling element is rotatably mounted on a frame which is rotatable around the axis of rotation of the first hair pulling element.

4. A depilator as claimed in claim 3, wherein the direction of rotation of the frame corresponds with the direction of rotation of the first hair pulling element.

5. A depilator as claimed in claim 3, wherein the direction of rotation of the frame is opposite to the direction of rotation of the first hair pulling element.

6. A depilator as claimed in claim 1, wherein there is a support member inside the first annular hair pulling element and the second hair pulling element is located between the first annular hair pulling element and the support member.

7. A depilator as claimed in claim 6, wherein the support member being driven in a rotatable fashion.

8. A depilator as claimed in claim 6 wherein the second hair pulling element is arranged as an annular deformable element compressed between the first annular hair pulling element and the support member.

9. A depilator claimed in claim 1 wherein no less than one of the hair pulling elements has a cladding of a rubber-elastic material.

10. A depilator as claimed in claim 1 wherein the hair pulling elements have corresponding teeth.

11. A depilator as claimed in claim 1 wherein there is a plurality of second hair pulling elements inside the first hair pulling element.

12. A depilator having a housing which includes in a wall thereof a skin-following surface for the skin to be depilated, at least one drivable first hair pulling element having an inside wall and rotatably mounted in the housing, the axis of the first element being directed perpendicular to the skin-following surface, and a plurality of second hair pulling elements adjoining the inside wall of the first hair pulling element the first hair pulling element being arranged annularly relative to at least one of the second hair pulling elements.

13. A depilator as claimed in claim 12, wherein the second hair pulling elements are inside the first hair pulling element.

14. A depilator as claimed in claim 12, wherein there is a support member inside the first hair pulling element and the second hair pulling elements are located between the first hair pulling element and the support member.

15. A depilator as claimed in claim 12, wherein there is a support member inside the first hair pulling element and the second hair pulling elements are deformable elements compressed between the first hair pulling element and the support member.

16. A depilator having a housing which comprises an annular wall portion which includes a plate having a skin-following surface for the skin to be depilated, a hair entry aperture, and at least one drivable annular first hair pulling element rotatably mounted in the housing, the axis of the first element being directed perpendicular to the skin-following surface;

at least one cylindrical second hair pulling element having an outside wall adjoining an inside wall of the first hair pulling element; and an opening between at least the first hair pulling element and the at least one cylindrical second hair pulling element wherein hair entering the hair entry aperture and present in the opening is clamped between at least the first hair pulling element and the at least one cylindrical second hair pulling element.

17. A depilator as claimed in claim 16, wherein the first hair pulling element comprises a gear ring engaging a pinion; wherein a plurality of second hair pulling elements are rotatably mounted on a drivable frame; and wherein a plate is not present on the annular wall portion of the housing, the skin-following surface being an annular end surface of the first hair pulling element.

18. A depilator having a housing which comprises:

an annular wall portion which includes a skin-following surface for the skin to be depilated, a hair entry aperture, and at least one drivable annular first hair pulling element rotatably mounted in the housing, the axis of the first element being directed perpendicular to the skin-following surface, the skin-following surface being defined by an annular end surface of the first hair pulling element and the first hair pulling element comprising a cylindrical support member and a gear ring engaging a pinion;

a plurality of deformable second hair pulling elements which are compressed between the first annular hair pulling element and the cylindrical support member; and an opening between at least the first hair pulling element and at least one of the compressed second hair pulling elements wherein hair entering the hair entry aperture and present in the opening is clamped between at least the first hair pulling element and at least one of the compressed second hair pulling elements.

* * * * *